United States Patent [19]

Prentiss et al.

[11] Patent Number: 4,526,581

[45] Date of Patent: Jul. 2, 1985

[54] PROCESS FOR PRODUCING LEATHER

[75] Inventors: William C. Prentiss, New Britain; David N. Price, Norristown, both of Pa.

[73] Assignee: Rohm and Haas Company, Philadelphia, Pa.

[21] Appl. No.: 464,236

[22] Filed: Feb. 7, 1983

[51] Int. Cl.[3] ..... C14C 3/22; C14C 3/28

[52] U.S. Cl. ..... 8/94.33; 8/94.21

[58] Field of Search ..... 8/94.33

[56] References Cited

U.S. PATENT DOCUMENTS 2,205,883 6/1940 Graves ..... 8/94.33
4,439,201 3/1984 Lauton et al. ..... 8/94.33

FOREIGN PATENT DOCUMENTS 0061420 9/1982 European Pat. Off. ..... 8/94.21
1535799 7/1968 France .

*Primary Examiner*—Maria Parrish Tungol
*Attorney, Agent, or Firm*—Alex R. Sluzas

[57] ABSTRACT

This invention is directed to an improved process for producing leather and products resulting thereby. The process employs methacrylic acid/alkyl acrylate copolymers having a narrow range of molecular weight and produces leather which is flexible, with a smooth grain and well-filled and which is resistant to detannage by washing with alkaline solution.

18 Claims, No Drawings

PROCESS FOR PRODUCING LEATHER

BACKGROUND OF THE INVENTION

1. Field of the Invention

This invention relates to an improved process for producing leather and products resulting therefrom. These compositions are copolymers of methacrylic acid and one or more alkyl acrylates and are characterized by a narrow molecular weight range. These tanning compositions and processes are useful in the pretanning, tanning, and retanning of leather. The leather produced by this improved process is flexible, with a smooth grain and well-filled, and is resistant to detannage by washing with alkaline solution.

2. Brief Description of the Prior Art

Phenolic syntans are synthetic resin tanning agents which can be used as sole tanning agents to replace natural tanning agents or in combination tannages to control leather fullness, yield, color, and processing properties. The use of phenolic syntans, however, presents a problem in that the effluent stream from the tanning may contain phenol and formaldehyde, two toxic materials. Thus there is a need for a synthetic tanning agent which can replace phenolic syntans in the tanning process without engendering toxic waste by-products. The synthetic methacrylic acid-alkyl acrylate copolymer compositions of the present invention can be used as sole tanning agents or in combination tannages with vegetable tannin, mineral or chrome tanning agents. These compositions are useful replacements for phenolic syntans. These compositions do not engender phenol or formaldehyde containing effluents. In addition, they exhibit light and oxidation stability which are superior to that shown by the phenolic syntans.

The use of acrylic acid and methacrylic acid copolymers as tanning compositions is well known in the art. For example, Graves in U.S. Pat. No. 2,205,882, granted June 25, 1940, discloses a process for tanning leather which comprises subjecting a skin to the action of an acidic polymeric material in which the acidity is due to carboxyl groups attached to aliphatic carbon atoms. Polyacrylic acid and copolymers of acrylic acid and methacrylic acid, and maleic anhydride and styrene are also disclosed to be useful. In U.S. Pat. No. 2,205,883 granted June 25, 1940, Graves discloses an improved process for tanning leather employing acid polymerization products of methacrylic acid as tanning agents. Polymethacrylic acid, partially hydrolyzed methyl methacrylate, methacrylic acid-styrene copolymer and methacrylic acid-methyl methacrylate copolymer are taught. Graves further discloses that solution viscosity and molecular weight may affect the rate and degree of tanning somewhat and further warns that very low molecular weight polymers should be avoided (Column 8, lines 56–66).

The methacrylic acid/alkyl acrylate copolymers of the instant invention are characterized by a specific and narrow molecular weight range. Surprisingly, this narrow molecular weight range is essential to realizing effective tanning of the leather stock. Also, the selection of methacrylic acid over acrylic acid is surprisingly essential as is the use of short chain alcohol esters of acrylic acid as comonomers with the methacrylic acid to achieve substantial resistance to detannage and grain cracking of the leather produced by the process.

An improved tanning composition made by copolymerization of a nixture of (a) methacrylic acid, acrylic acid, or mixtures of such acid with (b) a sulfated unsaturated oil is disclosed by W. J. Rau in U.S. Pat. No. 3,408,319, granted Oct. 29, 1968. Rau discloses that the most suitable molecular weight range of the copolymer product is from about 5000 to 50,000 number average (Column 2, lines 58–60).

J. A. Lowell et al. in U.S. Pat. No. 3,231,420, granted Jan. 25, 1956, disclose a process for providing leathers having improved break, fuller substance and improved resistance to abrasion and scuffing, which process comprises impregnating leathers with organic solvent solutions of copolymers and plasticizers. The water insoluble copolymers employed are prepared from (a) an acid selected from the group consisting of acrylic, methacrylic and itaconic acids, (b) at least one ester of acrylic or methacrylic acid and a saturated monohydric aliphatic alcohol having between 8 and 18 carbons atoms, (c) methyl, ethyl, or isobutyl methacrylate and (d) an ester of acrylic acid with a saturated monohydric alcohol having 1 to 4 carbon atoms. Lowell teaches that each of the 4 types of monomers employed in the polymer is essential. Further, in order to obtain good qualities in the impregnated leather, the average molecular weight of the copolymer is taught to be at least 10,000 (Column 2, lines 58–60).

A process for the filling of leather in compositions employed therein is taught by Wurmli et al. in U.S. Pat. No. 3,945,792, granted Mar. 23, 1976. The filling agent employed may consist of a homopolymer or copolymer selected from acrylic or methacrylic acid, or copolymers formed from acrylic or methacrylic acid and a vinyl unsaturated monomer selected from water insoluble comonomers such as acrylic or methacrylic acid alkyl esters having from 1 to 12 carbon atoms in the alkyl radical and a protein glue in a weight ratio of polymer to glue of from 1:12 to 12:1.

W. C. Beier et al. describe in U.S. Pat. No. 4,312,802, granted Feb. 9, 1982, a multistage process for producing leather, one step of which consists of treating leather stock with a tanning composition comprising an aqueous dispersion or solution of a polymer polymerized from a monomer mixture comprising at least one member selected from the group consisting of acrylic acid, methacrylic acid, mixtures of acrylic acid and methacrylic acid and mixtures of a major proportion of at least one member selected from the group consisting of acrylic acid and methacrylic acid with a minor proportion of at least one component selected from the group consisting of alkyl esters of acrylic acid, alkyl esters of methacrylic acid and partially sulfated unsaturated drying oils. Beier et al. do not disclose any limitation on the molecular weight of methacrylic acid alkyl acrylate copolymer tanning agents. Beier et al.'s process further requires an additional tanning step. The copolymers of the instant invention may be used to tan leather for shoe soles.

R. Monsheimer et al. disclose in U.S. Pat. No. 4,314,800, granted Feb. 9, 1982, a method for treating pelts and leather in the beam house for tanning or as an after treatment which consists of contacting such pelts or leather with an aqueous solution or dispersion of a copolymer comprising monomers of a nitrogenous ester of acrylic acid or methacrylic acid, a further different ester of acrylic acid or methacrylic acid and acrylic acid or methacrylic acid whereby portions of the copolymer are deposited in the grain boundary without formation of a superficial film.

H. Lochel disclose in U.S. Pat. No. 4,345,006, granted Aug. 17, 1982, methods for treating tanned leather with a dispersion of an acrylate resin comprising certain acrylate and/or methacrylate esters, a hydroxyalkyl acrylate or methacrylate, an unsaturated polymerizable anionic compound such as an unsaturated carboxylic acid, a crosslinking monomer and, optionally, acrylamide or methacrylamide.

In situ polymerization of aqueous dispersions of monomers and polymers in order to incorporate large proportions of high molecular weight polymers in leather in order to improve leather mechanical properties is taught by E. Bader et al. in U.S. Pat. No. 3,291,558, granted Dec. 13, 1966. Similarly, sheepskin leather which exhibits an unusual weak internal fiber strength tending to cause "double hiding" can be remedied by precipitating an elastomeric resin material within the leather by repeatedly subjecting the leather to pressure and release of the pressure according to R. H. Doggett et al. as disclosed in U.S. Pat. No. 3,245,832, granted Apr. 12, 1966.

None of the prior art references disclose or suggest the specific and narrow molecular weight range methacrylic acid-short chain alkyl acrylate copolymer tanning agents of the present invention.

SUMMARY OF THE INVENTION

It is an object of this invention to provide an improved process for the tanning of leather. Another object is to provide an improved process for the pretanning of leather. Yet another object is to provide an improved process for the retanning of leather. Another object of this invention is to provide a process for producing leather which is perfectly white (i.e. opaque), flexible, with a smooth grain and well filled. Another object of this invention is to provide a process for producing leather which is resistant to detannage by washing with alkaline solution. Another object of this invention is to provide an improved process for producing leathers which are flexible and which have an acceptable grain strength. Yet another object of this invention is to produce white leather. Still another object is to provide improved tanning compositions useful in the pretanning, tanning, retanning of leather. Further objects of this invention will become apparent hereinafter.

These and other objects of the invention are achieved by use of an improved process for producing leather, the improvement therein characterized by use of a copolymer tanning agent comprising at least 60 mole percent residues of methacrylic acid and at least about 5 mole percent of residues of at least one alkyl acrylate selected from methyl, ethyl, propyl, and butyl acrylates, said copolymer having a weight average molecular weight from about 3,500 to 9,000. A copolymer comprising from about 5 to 40 mole percent of residues of at least one ($C_1$–$C_4$) alkyl acrylate is preferred. A weight average molecular weight of from about 4,000 to about 7,500 is preferred. Ethyl acrylate is a preferred comonomer. When a copolymer prepared from methyl acrylate and methacrylic acid comonomers is employed, it is preferred that the copolymer consist of no more than about 30 parts by weight of methyl acrylate residues. When a copolymer prepared from ethyl acrylate and methacrylic acid comonomers is used, it is preferred that the polymer consist of no more than 25 parts per weight of ethyl acrylate residues. When a copolymer prepared from butyl acrylate and methacrylic acid comonomers is used, it is preferred that the copolymer consist of no more than 15 parts by weight of residues of butyl acrylate.

The optimum proportion of alkyl acrylate in the copolymer depends upon the pH, proportion of polymer solids in the tanning solution, and the process of polymer preparation.

The processes of the present invention may be used in the pretanning, tanning or retanning of leather. These processes may be used in combination with processes employing trivalent chromium compounds, such as acidified trivalent chromium sulfate (chrome tanning), vegetable tannins, including tannins extracted from wood, bark, leaves, fruits, pods and roots, other mineral tannages such as zirconium, aluninum and iron tannages, polyphenolic syntans such as sulfonated low molecular weight condensation polymers of aromatic phenols and formaldehyde, low molecular weight condensation polymers of sulfonated naphthalene and formaldehyde, aminoplast tannages such as N-methol or N-alkoxymethyl functional derivatives of polyamines such as melamine, dicyandiamide and urea (e.g. hexa(-methoxymethyl) melamine), oil tannages, aldehyde tannages such as formaldehyde and gluturaldehyde, or other materials disclosed in the prior art One indication of the tanning of a pelt is an increase in its shrinkage temperature or hydrothermal stability ($T_s$). The skin collagen fiber network within pelt or untanned skin, pickled to an equilibrium pH of about 4, will usually withstand immersion in water up to 58°–60° C. before it shrinks or becomes denatured. Tanning processes introduce crosslinks into the collagen structure and therefore increase its resistance to hydrothermal shrinkage. For example, chromium tanned collagen will withstand hydrothermal temperatures in excess of 100° C. without shrinking or becoming denatured. Therefore an increase in hydrothermal stability is an indication that some degree of tannage has occurred.

Another measure of the quality of the tanning process is the resistance of the tanned leather to reversibility or detannage. Many tanning processes are wholly or partially reversible, especially when the tanned leather is exposed to washing with an alkaline aqueous solution. The leather may revert completely to untanned skin with a consequent reduction in shrinkage temperature. A measure of resistance to detannage of polymer tanned leather is provided by the following test: A standard weighed quantity of dried tanned leather is stirred into a standard volume of distilled water. The distilled water is constantly maintained at a pH of 7 by addition of standard alkali solution. The rate at which alkali is consumed gives a useful indication of the rate at which originally fixed polymer is reversibly removed from the skin. If the polymer is removed very slowly and sparingly, the leather is considered to be practically resistant to detannage. The shrinkage temperature is also noted at various stages during this test. A strong resistance to detannage is desirable.

A particular tanning process may impart a variety of undesirable characteristics to the leather produced. For example, lack of flexibility, excessive grain crackiness, translucency, emptiness and hardness may characterize the leather produced. All of these undesirable characteristics should be minimized and visual assessment of these is regarded as an additional measure of tannage.

In order to reduce effluent contamination and processing costs it is desirable to achieve efficient use of a tanning agent during processing. The degree of efficiency or exhaustion may also be taken as a measure of tannage.

The resistance to detannage of a polymer tanned leather is believed to be related to the solubility of the polymer tanning agent. One measure of polymer solubility is provided by the precipitation pH characteristics of the copolymer. These can be probed by a test in which a 5% (by weight of copolymer) solution having a fixed concentration of dissolved sodium chloride is titrated with acid. The pH at which precipitation of the polymer commences is noted. Precipitation pHs are noted for 4, 5, 6 and 7% by weight of sodium chloride solutions containing 5% polymer. Precipitation pH is taken to be directly correlated with copolymer insolubility. Resistance to detannage increases with increasing insolubility and comparison of the precipitation pH of different copolymers gives an indication of relative resistance to detannage.

The term "leather stock" is used herein to mean animal hide or skin that has been conventionally limed, bated or pickled. The amounts and percentages of materials used in the process of this invention are adjusted within ranges set forth to account for the difference in water content of the particular leather stock used.

The leather stock used in the process of the invention may be derived from any known animal hide or skin. The hides may be bovine or equine hides and the skins may be ovine skins, goat skins and pigskins.

In one embodiment of this invention the copolymer solution is drummed with pickled pelt or delimed pelt (leather stock) adjusted to a pH of from about 4 to 5.6. Drumming is continued until the polymer has penetrated into the pelt. Once penetration of the polymer has been achieved the pH is slowly lowered to about 3.7 to effect both tannage and exhaustion. The level of polymer employed is from about 3 to 20% and preferably from about 10 to 15% based on the limed weight of the pelt.

The preparation of the copolymer tanning agents is well known in the acrylic polymer art. The copolymers of the present invention may be prepared in any appropriate fashion provided they are of the proper molecular weight range as defined herein above. For example, the copolymers may be prepared by free radical initiated aqueous batch polymerization. Any appropriate solvent may be employed; however, water is preferred.

Unless otherwise noted, molecular weights referred to herein are weight-average molecular weights (Mw) obtained by gel permeation chromatography.

The following monomer abbreviations are employed in the tables below:

| | |
|---|---|
| Methacrylic acid | MAA |
| Ethyl acrylate | EA |
| Butyl acrylate | BA |
| Methyl methacrylate | MMA |
| Methyl acrylate | MA |

In addition to the ($C_1$–$C_4$) alkyl acrylate comonomers hereinabove described minor amounts of additional monomers, such as alpha, beta-ethylenically unsaturated mono- and di- carboxylic acids (other than methacrylic acid), $C_5$-and-above alkyl esters of acrylic acid, alkyl esters of methacrylic acid, and hydroxyalkyl acrylates and methacrylates may also be used in preparing the copolymers used in the instant invention, provided that the copolymers contain at least five mole percent of monomer residues selected from the ($C_1$–$C_4$) alkyl acrylates. Examples of such additional monomers include methyl methacrylate, acrylic acid, itaconic acid, 2-ethyl hexyl acrylate, hydroxyethyl methacrylate and hydroxyethyl acrylate.

Leathers tanned with polymethacrylic acid may be readily detanned by washing in water, especially when the pH of the wash is maintained above 5.0. The resistance to detannage of leathers obtained by polymethacrylic acid (Mw 4700), a copolymer of methyl methacrylate and methacrylic acid, and copolymers of methacrylic acid and ethyl acrylate was determined as described hereinabove. The results of these tests are reported in Table I below.

TABLE I

| Polymer Type | Ts at start of test | Ts at end of test | Percentage[1] polymer extracted | Appearance of washed leathers |
|---|---|---|---|---|
| Polymethacrylic acid (MAA//100) | 76° C. | 67° C. | 23% | brittle, translucent, (detanned appearance) |
| MAA/MMA// 90/10 | 73° C. | 69° C. | 12.8% | brittle, but white |
| MAA/EA// 90/10 | 69.5° C. | 69.5° C. | 8.5% | white, slightly firm, flexible (leatherlike) |
| MAA/EA// 80/20 | 66° C. | 66° C. | 5% | white, softer, flexible (leatherlike) |
| Control (Pelt pickled to pH 4.0) | 58° C. | 58° C. | — | hard, horny, translucent material resembling untanned pelt |

[1]Polymer extracted from tanned leathers after washing for 1 hour at equilibrium pH 7.0.

Leathers tanned with the copolymer tanning agents were much more resistant to detannage than the leather tanned with polymethacrylic acid. In addition, the appearance of the washed leather, tanned by the polymethacrylic acid was inferior to that obtained with the copolymer tanning agents. The washed leather, tanned with the methyl methacrylate/methacrylic acid copolymer exhibited pronounced crackiness of the grain, whereas those washed leathers, obtained by tannage with the ethyl acrylate copolymers, remained relatively full and flexible with little or no grain crack. Increasing the proportion of ethyl acrylate in the copolymer increased the resistance to detannage. However, increasing the proportion of ethyl acrylate decreases the shrinkage temperature of the leather obtained.

An acceptably tanned leather is judged to have a shrinkage temperature in excess of about 58° C. The degree of solubility of the copolymers of the present invention is such that they produce leathers which resist detannage and yet possess acceptable shrinkage temperatures. The effect of copolymer composition on shrinkage temperatures shown in Table II below.

TABLE II

| Polymer Type | Ts | Comments |
|---|---|---|
| AA//100 | 58° C. | untanned, brittle, horny |
| MAA//100 | 74° C. | |
| MAA/BA//95/5 | 72.5° C. | |
| MAA/BA//90/10 | 71° C. | limited solubility, requires soap to stabilize |
| MAA/EA//90/10 | 69.5° C. | |
| MAA/EA//80/20 | 66.5° C. | |
| MAA/EA//70/30 | 64° C. | |
| MAA/MA//80/20 | 62° C. | |
| MAA/MA//70/30 | 58° C. | borderline tannage |

The results reported in Table II indicate that increasing the proportion of the alkyl acrylate comonomer in the copolymer decreases the shrinkage temperature and that different temperature regimes exists for each type of alkyl acrylate comonomer.

In contrast to the teaching of the prior art, it has been found that polyacrylic acid has itself no tanning ability.

Because resistance to detannage increases with increasing insolubility, comparison of precipitation pH of this class of copolymers gives an indication of the relative resistance to detannage of these copolymers. The precipitation pH values for a number of copolymer solutions are given in Table III below.

TABLE III

| Polymer type | Mw | pH[1] Sodium chloride conc. (u/v) 4% | 5% | 6% | 7% | Ranking order of insolubility 1-5 |
|---|---|---|---|---|---|---|
| Polymethacrylic acid (MAA) | 4,700 | No precipitation | | | | 5 |
| MAA/EA// 90/10 | 4,890 | 1.0 | 2.5 | 3.6 | 3.9 | 3 |
| MAA/EA// 80/20 | 6,830 | 4.4 | 4.7 | >4.7 | >4.7 | 1 |
| MAA/MMA// 90/10 | 4,560 | No precipitation | | | 0.6 | 4 |
| MAA/MMA// 80/20 | 4,810 | 3.0 | 3.3 | 3.8 | 3.9 | 2 |

[1]"Precipitation pH" values of 5% (w/v) polymer solutions (aqueous) at different levels of sodium chloride concentration The results in Table III indicate that insolubility increases with increasing proportion of alkyl acrylate comonomer.

In order to aid in understanding this invention, the following specific examples are provided as illustrations. The scope of this invention is in no way limited by these examples.

POLYMER PREPARATION

Example A

In a polymerization vessel equipped with a reflux condenser, a stirrer and a thermometer, 1.1 g of ammonium persulphate are dissolved in 127 g water at 90° C. To this solution is added dropwise over a period of 1½ hrs a mixture containing 90 g of methacrylic acid, and 10 g of ethyl acrylate simultaneously with a solution of 2.2 g of ammonium persulphate dissolved in 54 g water.

This batch is maintained at 90° C. for ½ hr and then allowed to cool to 60° C. The batch is then carefully partially neutralized by the dropwise addition of a solution consisting of 7.18 g sodium hydroxide dissolved in 51 g water. The copolymer obtained by this procedure has a weight average molecular weight of 9800.

Example B

In a polymerization vessel equipped with a reflux condenser, a stirrer and a thermometer, 1.1 g of ammonium persulphate are dissolved in 127 g of water at 90° C. To this solution is added dropwise over a period of 1½ hrs a mixture containing 90 g of methacrylic acid, and 10 g ethyl acrylate simultaneously with a solution consisting of 10.8 ammonium persulphate dissolved in 54 g water.

This batch is maintained at 90° C. for ½ hr and then allowed to cool to 60° C. The batch is then carefully partially neutralized by the dropwise addition of a solution consisting of 7.18 g sodium hydroxide dissolved in 61mg of water. The copolymer obtained by this procedure has a weight average molecular weight of 5700.

Example C

In a polymerization vessel equipped with a reflux condenser, a stirrer and a thermometer, 1.2 g of ammonium persulphate are dissolved in 127 g water at 90° C. To this solution is added dropwise over a period of 1½ hrs a mixture containing 90 g of methacrylic acid and 10 g of ethyl acrylate, simultaneously with a solution of 16.8 g of ammonium persulphate dissolved in 54 g of water.

This batch is maintained at 90° C. for ½ hr and then allowed to cool to 60° C. The batch is then carefully partially neutralized by the dropwise addition of a solution consisting of 7.18 g sodium hydroxide dissolved in 51 g of water. The copolymer obtained by this procedure has a weight average molecular weight of 3700.

Example D

In a polymerization vessel equipped with a reflux condenser, a stirrer and a thermometer, 1.2 g of ammonium persulphate are dissolved in 127 g of water at 90° C. To this solution, is added dropwise over a period of 1½ hrs 100 g of methacrylic acid, simultaneously with a solution of 10.8 g of ammonium persulphate dissolved in 54 g of water.

This batch is maintained at 90° C. for ½ hr and then allowed to cool to 60° C. The batch is then carefully partially neutralized by the dropwise addition of a solution consisting of 7.18 g sodium hydroxide dissolved in 51 g of water. The polymethacrylic acid obtained by this procedure has a weight average molecular weight of 5600.

Example E

The procedure used in Example D is followed exactly with the exception that the methacrylic acid is substituted for a mixture containing 90 g methacrylic acid and 10 g methyl methacrylate. The copolymer obtained in this process has a weight average molecular weight of 5460.

TANNING PROCESSES

Example 1

1000 grams of limed split stock is delimed and bated using a conventional procedure.

The delimed, bated stock is flqated in 1000 g of a 10% sodium chloride solution. The stock is drummed for 10 minutes and 10 g of sulphuric acid (diluted 1:5 with water) is added. The drumming is continued for 3 hrs and the stock left in this pickle overnight. The next morning the stock is drummed for 2 hours. The pH of the liquor is 4.2 and a cross section cut of pelt indicates 4.0–4.2 throughout the cross section with brom-phenol blue and brom-cresol green indicators. The pickle liquor is then drained from the stock. A new float is prepared consisting of 400 g of a 3% sodium chloride solution and 400 g of the solution prepared in Example B. Drumming is then continued for 3 hours and a cross section cut tested with 10% w/v copper sulphate solution in order to check penetration of the copolymer. Penetration is complete at this stage. However, drumming is continued for a further 3 hours to ensure satisfactory distribution of polymer within the skin. Fixation and exhaustion is finally completed by adding 50 ml of 10% hydrochloric acid in two half hour additions. Drumming is further continued for 1½ hrs when the final liquor pH was 3.7.

The tanned stock is rinsed in water and hung to air dry. The shrinkage temperature of the tanned stock is 69.5° C. and the exhaust efficiency 91% polymer uptake. The air dry leather is full, white with a pleasant handle with little or no crackiness of the grain. The resistance to detannage of this leather is considerably superior to that of the leather tanned with polymethacrylic acid (Mw-4700) as prepared in Example 2. Extracting pieces of the tanned leather by stirring in distilled water while maintaining an equilibrium pH of 7.0, by steady addition of standard alkali, indicates that orly 8.5% of the polymer within the leather is extracted as compared to the 23% extracted from the leather tanned with polymethacrylic acid. Moreover, there is no recorded loss of hydrothermal stability and the washed leather pieces retains reasonable leather-like properties.

Example 2

The procedure described in Example 1 is followed exactly, with the exception that 400 g of the solution prepared as described in Example D is used as the tanning agent. A full, white leather is obtained which exhibited significant crackiness of the grain when flexed, in particular, as conditioning at low relative humidity. The shrinkage temperature of the leather obtained is 76° C. and the exhaust efficiency 84% polymer uptake. The resistance to detannage as measured by the extraction test previously described shows that 23% of the polymer, originally within the leather, is removed, accompanied by a fall in shrinkage temperature to 67° C. and considerable loss of leather-like properties.

Example 3

The procedure described in Example 1 is followed exactly with the exception that 400 g of the solution prepared as described in Example A is used as the tanning agent. The penetration of the copolymer into the skin is slower, the shrinkage temperature of the leather obtained is 69° C. and the exhaust efficiency lower at 70% polymer uptake.

The leather obtained is quite full and flexible but exhibits some grain crackiness. In general, it is inferior to the leather obtained in Example 1.

Example 4

The procedure described in Example 1 is followed exactly with the exception that 400 g of the solution prepared as described in Example C is used as the tanning agent. The shrinkage temperatue of the leather obtained is 68° C. and the exhaust efficency 74% polymer uptake. The leather obtained has a slightly empty feel with a tendency for grain crack. It is also much less resistant to detannage by washing with alkali when compared to the leather obtained in Example 1.

Example 5

The procedure described in Example 1 is followed exactly with the exception that 400 g of the solution prepared as described in Example E is used as the tanning agent. A white full leather is obtained which exhibited significant crackiness of the grain upon flexing. The shrinkage temperature of the leather is 73° C. and the exhaust efficiency is 84% polymer uptake. The resistance to detannage as measured by the extraction test previously described shows that 12.8% of the polymer, originally in the leather, is removed accompanied by a fall in shrinkage temperature to 69° C. The washed leather is still white, but more brittle than the original.

Example 6

The solution prepared as described in Example B is used as a pretannage prior to the drum application of vegetable tannage in sole leather processing. This pretannage assists in the retention of an exceptionally smooth grain, a desirable feature for sole leather.

Example 7

The solution prepared as described in Example B is used in conjunction with vegetable tanning materials in the pit or vat processing of the leather. A leather with an exceptionally smooth grain and pale color is obtained.

Example 8

The solution prepared as described in Example B is used in combination tannages with metal salts based on aluminum, zirconium, copper and chromium to produce white or pale blue leather which have shrinkage temperatures in excess of 90° C.

Example 9

The solution prepared as described in Example B is used in the retannage of zirconium or chromium tanned leathers either alone or in combination with metal salts based on aluminum, chromium, or zirconium. An improved leather is obtained which has an exceptionally smooth grain.

Surprisingly, study of the molecular weight distribution of tanning liquors of the copclymers of this invention (e.g. Example A, Mw 3700, Example B, Mw 5700, and Example C, Mw 9800) during the tanning process, indicates there is a preferential uptake of copolymer molecules lying within the weight average molecular weight range 3500–9000. The best leathers and tanning exhaust efficiencies among Examples A, B and C are obtained with Example B, Mw 5700. A copolymer with weight average molecular weight within the range of 4000–7500 is preferred for optimum tanning performance.

We claim:

1. In a process for producing leather the use as a tanning agent of a copolymer comprising at least 60 mole percent of residues of methacrylic acid and at least about 5 mole percent of residues of at least one ($C_1$–$C_4$) alkyl acrylate, said copolymer having a weight average molecular weight from about 3500 to 9000.

2. The process of claim 2 wherein the copolymer comprises from about 5 to 40 mole percent of residues of at least one ($C_1$–$C_4$) alkyl acrylate.

3. The process of claim 2 wherein the copolymer consists essentially of residues of methacrylic acid and from about 5 to 30 mole percent of residues of methyl acrylate.

4. The process of claim 2 wherein the copolymer consists essentially of residues of methacrylic acid and from about 5 to 25 mole percent of residues of ethyl acrylate.

5. The process of claim 2 wherein the copolymer consists essentially of residues of methacrylic acid and from about 5 to 15 mole percent of residues of butyl acrylate.

6. The process of claim 2 wherein the weight average molecular weight of the copolymer is from about 4000 to about 7500.

7. The process of claim 3 wherein the weight average molecular weight of the copolymer is from about 4000 to about 7500.

8. The process of claim 4 wherein the weight average molecular weight of the copolymer is from about 4000 to about 7500.

9. The process of claim 5 wherein the weight average molecular weight of the copolymer is from about 4000 to about 7500.

10. The product of the process of claim 1.
11. The product of the process of claim 2.
12. The product of the process of claim 3.
13. The product of the process of claim 4.
14. The product of the process of claim 5.
15. The product of the process of claim 6.
16. The product of the process of claim 7.
17. The product of the process of claim 8.
18. The product of the process of claim 9.

* * * * *

UNITED STATES PATENT AND TRADEMARK OFFICE

CERTIFICATE OF CORRECTION

PATENT NO. : 4,526,581

DATED : July 2, 1985

INVENTOR(S) : William C. Prentiss et al.

It is certified that error appears in the above-identified patent and that said Letters Patent is hereby corrected as shown below:

Claim 2, line 1 "2" should read --1--.

Signed and Sealed this

*Twenty-ninth* Day of *July 1986*

[SEAL]

*Attest:*

DONALD J. QUIGG

*Attesting Officer*

*Commissioner of Patents and Trademarks*